US005306526A

United States Patent [19]

Gray et al.

[11] Patent Number: 5,306,526

[45] Date of Patent: Apr. 26, 1994

[54] METHOD OF TREATING NONFERROUS METAL SURFACES BY MEANS OF AN ACID ACTIVATING AGENT AND AN ORGANOPHOSPHATE OR ORGANOPHOSPHONATE AND SUBSTRATES TREATED BY SUCH METHOD

[75] Inventors: Ralph C. Gray, Butler; Michael J. Pawlik, Glenshaw; Charles F. Kahle, II, Allison Park; Paul J. Pruchal, Pittsburgh, all of Pa.

[73] Assignee: PPG Industries, Inc., Pittsburgh, Pa.

[21] Appl. No.: 862,143

[22] Filed: Apr. 2, 1992

[51] Int. Cl.[5] ..... B05D 3/10

[52] U.S. Cl. ..... 427/309; 427/327; 427/419.8; 427/353; 148/247

[58] Field of Search ..... 427/301, 304, 309, 419.8, 427/443.1, 327, 353; 148/247

[56] References Cited

U.S. PATENT DOCUMENTS

| | | | |
|---|---|---|---|
| 630,246 | 8/1899 | Loeb | 427/309 |
| 3,202,534 | 8/1965 | Duch et al. | 427/327 |
| 3,269,812 | 8/1966 | Irani et al. | 44/72 |
| 3,482,951 | 12/1969 | Hubbell et al. | 427/327 |
| 3,956,199 | 5/1976 | Dawson et al. | 252/545 |
| 4,051,110 | 9/1977 | Quinlan | 260/72 R |
| 4,111,722 | 9/1978 | Reghi et al. | 148/6.15 R |
| 4,125,648 | 11/1978 | Vratny | 427/437 |
| 4,180,603 | 12/1979 | Howell, Jr. | 427/353 |
| 4,187,127 | 2/1980 | Yashiro et al. | 148/6.15 R |
| 4,312,922 | 1/1982 | Caule | 427/417 |
| 4,339,310 | 7/1982 | Oda et al. | 204/38 R |
| 4,391,652 | 7/1983 | Das et al. | 148/247 |
| 4,621,112 | 11/1986 | Backhouse et al. | 524/145 |
| 4,705,703 | 11/1987 | Meier et al. | 427/239 |
| 4,717,424 | 1/1988 | Wilfinger et al. | 106/308 Q |
| 4,735,649 | 4/1988 | Dhingra et al. | 71/86 |
| 4,777,091 | 10/1988 | Dettloff et al. | 428/418 |
| 4,781,984 | 11/1988 | Cavitt et al. | 428/418 |
| 4,786,336 | 11/1988 | Schoener et al. | 148/247 |
| 4,814,209 | 3/1989 | Arnold | 427/409 |
| 4,902,535 | 2/1990 | Garg et al. | 427/443.1 |
| 4,939,001 | 7/1990 | Brodalla et al. | 427/419.8 |
| 4,988,396 | 1/1991 | Bibber | 148/273 |
| 4,992,116 | 2/1991 | Hallman | 148/247 |
| 5,034,556 | 7/1991 | Kahle, II | 558/155 |

FOREIGN PATENT DOCUMENTS

| | | |
|---|---|---|
| 1276822 | 6/1972 | United Kingdom . |
| 2004569 | 4/1979 | United Kingdom . |
| 2032963 | 5/1980 | United Kingdom . |
| 2138424 | 10/1984 | United Kingdom . |

OTHER PUBLICATIONS

Helmut Blum and Peter Christophliemk, "Technical Aminopolymethylenephosphonic Acids as Scale Inhibitors", *Phosphorus and Sulfur*, 1987, vol. 30, pp. 619–622 (no month available).

Phosphates Division of Albright & Wilson, 'Briquest' Phosphonates as Sequestrants and Surfactants, pp. 1–4, Product Technical Information, Jun. 1982.

Phosphates Division of Albright & Wilson, 'Briquest' ADPA-60A, Acetodiphosphonic Acid Aqueous Solution, 2 sheets (no date available).

Monsanto Company, "Dequest 2000 and 2006 Phosphonates", Technical Bulletin No. IC/WT-101, 5 sheets (no date available).

Monsanto Company, "Dequest 2010 Phosphonate", Technical Bulletin No. IC/SCS-323, 3 sheets (no date available).

(List continued on next page.)

*Primary Examiner*—Shrive Beck
*Assistant Examiner*—Diana Dudash
*Attorney, Agent, or Firm*—William J. Uhl

[57] ABSTRACT

A method of treating a nonferrous metal substrate such as aluminum with an acid activating agent such as HF followed by treating with an organophosphate or organophosphonate. The treatment provides for improved adhesion and flexibility as well as resistance to humidity, salt spray corrosion and detergents of subsequently applied coatings.

19 Claims, No Drawings

OTHER PUBLICATIONS

Monsanto Company, "Dequest 2041 and 2051 Phosphonates", 7 sheets (no date available).

Monsanto Company, "Dequest 2060 Organophosphorus Product", Technical Bulletin No. IC/SCS-322, 3 sheets (no date available).

Albright & Wilson Inc. "Organophosphorus Chemicals", 1 sheet; Flame Retardants, 2 sheets; Surfactants, 2 sheets; Functional Fluid Additives and Precursors, 2 sheets; Sequestrants, Corrosion and Scale Inhibitors, 1 sheet; Lubricant Additives, 1 sheet; Inorganic Chemicals, 2 sheets; Proprietary Metal Finishing Processes, 1 sheet; and Products by Industry, 2 sheets (no date available).

Alfred Bader, "How to Find a Great Herbicide", *Aldrichimica Acta,* vol. 21, No. 1, 1988 (no month available).

Goncalves et al, Chemical Abstracts, vol. 89, No. 129606 (1978) no month available.

Goncalves et al., Chemical Abstracts, vol. 89, No. 129607 no month available.

METHOD OF TREATING NONFERROUS METAL SURFACES BY MEANS OF AN ACID ACTIVATING AGENT AND AN ORGANOPHOSPHATE OR ORGANOPHOSPHONATE AND SUBSTRATES TREATED BY SUCH METHOD

BACKGROUND OF THE INVENTION

The present invention relates to metal pretreatment methods which do not involve the use of chromium compounds and, in particular, such methods which are useful in treating nonferrous metal surfaces and particularly aluminum, zinc and aluminum-zinc alloy surfaces.

BRIEF DESCRIPTION OF THE PRIOR ART

It is known to treat nonferrous metals and particularly aluminum, zinc and aluminum-zinc alloys with chromium compounds such as chromic acid to inhibit corrosion and promote adhesion with coatings. While effective, the chromium compounds, nonetheless, are undesirable because of their toxicity and the attendant problems of disposal.

Hence, considerable work has been done in finding a replacement for the chromium in metal pretreatment. The present invention provides a treatment method which does not involve the use of chromium compounds.

SUMMARY OF THE INVENTION

The invention encompasses a method of treating a nonferrous metal substrate comprising contacting the substrate with an acid activating agent, and then contacting the substrate with an organophosphate or organophosphonate. The invention also encompasses a nonferrous metallic substrate treated by such method. The term "nonferrous" is meant to include metals other than iron, such as aluminum and zinc and alloys of aluminum and zinc, as well as alloys containing minor portions of up to 15 percent by weight iron. Preferably, the nonferrous metallic substrate contains no iron.

DETAILED DESCRIPTION OF THE INVENTION

The acid activating agent is necessary to prepare the substrate for the subsequent treatment with the organophosphonate or organophosphate. It is believed that the acid activating step dissolves metal oxide films which may form on the nonferrous metal surface making the surface more receptive to the subsequently applied organophosphonate or organophosphate.

The acid activating agent is desirably applied by contacting the metallic substrate such as by immersion or spraying at a temperature of from 50° F. (10° C.) to 150° F. (66° C.), preferably 65° F. (18° C.) to 80° F. (27° C.). Usually it will have a pH of from 2.4 to 4.0 and preferably from 3.0 to 3.7. The activating agent is preferably an aqueous solution of an acidic fluoride compound. Examples of acidic fluoride compounds are hydrofluoric acid, fluorosilicic acid, sodium hydrogen fluoride and potassium hydrogen fluoride. The acid activating agent can be a mixture of a fluorosilicate such as fluorosilicic acid and an alkali fluoride such as sodium fluoride. The pH can be adjusted by the addition of base such as sodium hydroxide. The acidic fluoride compound is preferably used in amounts to provide a concentration of from 100 to 5200 ppm fluoride and more preferably a concentration of from 600 to 2600 ppm fluoride.

After contacting the nonferrous metallic surface or substrate with the acid activating agent and before contacting with the organophosphate or organophosphonate, the substrate may optionally be contacted with an aqueous solution of complex fluorotitanium or fluorozirconium compound. Examples of such complex compounds are fluorotitanic acid, fluorozirconic acid, sodium hexafluorotitanate, potassium hexafluorotitanate and potassium hexafluorozirconate. Such complex compounds are preferably used in amounts to provide a concentration of from 100 to 800 ppm titanium and/or zirconium.

The useful organophosphate or organophosphonate is compatible with an aqueous medium, i.e., soluble or dispersible to the extent of at least 0.05 gram per 100 grams of water at 25° C. The aqueous solution can be prepared by mixing the organophosphate or organophosphonate compound with an aqueous medium, preferably at a temperature of about 50° F. (10° C.) to 150° F. (66° C.) and more preferably at about 60° F. (16° C.) to 80° F. (27° C.). By an aqueous medium is meant water or water in combination with cosolvent such as an alkyl ether of a glycol, such as 1-methoxy-2-propanol, dimethylformamide or a base such as an amine that can partially neutralize the organophosphate or organophosphonate to enhance the solubility of the organophosphate or organophosphonate compound.

The organophosphate or organophosphonate compound may be a phosphoric acid ester or a phosphonic acid ester of an epoxy compound. Examples of suitable phosphonic acids are methylene phosphonic acids, particularly alpha-aminomethylene phosphonic acids containing at least one group of the structure:

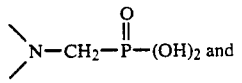

alpha-carboxymethylene phosphonic acids having a group of the structure:

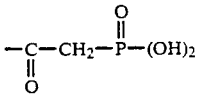

Examples of specific phosphonic acids include benzylaminobis(methylenephosphonic) acid, cocoaminobis(methylenephosphonic) acid, triethylsilylpropylaminobis(methylenephosphonic) acid and carboxyethyl phosphonic acid.

Examples of epoxy compounds are 1,2-epoxy compounds and include polyglycidyl ethers of polyhydric phenols such as the polyglycidyl ether of 2,2-bis(4-hydroxyphenyl)propane, i.e., bisphenol A, and 1,1-bis(4-hydroxyphenyl)isobutane. Also, the epoxy compound may be a monoglycidyl ether of a monohydric phenol or alcohol such as phenyl glycidyl ether and butyl glycidyl ether. Also, mixtures of epoxy compounds may be used.

Examples of suitable organophosphates and organophosphonates include phosphoric acid ester of bisphenol A diglycidyl ether; benzylaminobis(methylenephosphonic) acid ester of bisphenol A diglycidyl ether; carboxyethyl phosphonic acid ester of bisphenol A diglycidyl ether and of phenylglycidyl ether and of butyl glycidyl ether; carboxyethyl phosphonic acid mixed ester of bisphenol A diglycidyl ether and butylglycidyl ether; triethoxyl silyl propylaminobis(methylenephosphonic) acid ester of bisphenol A diglycidyl ether and cocoaminobis(methylenephosphonic) acid ester of bisphenol A diglycidyl ether.

The organophosphate or organophosphonate is applied to the metallic substrate under conditions that produce a corrosion-resistant barrier which is receptive to a subsequent coating process such as a spray, dip or roll coating. The organophosphate or organophosphonate is applied to the metal surface by contacting the metal surface with the solution by spraying or immersion techniques. The temperature of the solution is typically from about 50° F. (10° C.) to 150° F. (66° C.) and preferably about 60° F. (16° C.) to 80° F. (27° C.). The pH of the preferred treating composition during application is typically about 3.5 to 7.0 and preferably about 4.0 to 6.5. The organophosphate or organophosphonate is typically present in the solution in amounts of about 0.05 to 7.0 percent and preferably about 0.65 to 0.80 percent; the percentage being by weight based on weight of solution. After the aqueous composition has been applied, the metal is usually rinsed with deionized water, dried with heat to preferably 40° C. to 130° C. and more preferably from 60° C. to 115° C. and then coated with a surface coating.

In a typical treatment process, the nonferrous metal substrate is first cleaned by a physical or chemical means and rinsed with water followed by contacting the metallic substrate with the acid activating agent and optionally the complex fluorotitanium or fluorozirconium compound as described above. The metallic substrate is then rinsed with water and then contacted with the organophosphate or organophosphonate as described above. The metallic substrate can then be given a final deionized water rinse and the substrate dried by heating followed by the application of a coating composition by conventional means such as spraying or roll coating. The pretreatment process of the invention results in improved adhesion and flexibility and resistance to humidity, salt spray corrosion and detergents of subsequently applied coatings.

The invention is further illustrated by the following non-limiting examples. All parts are by weight unless otherwise indicated.

EXAMPLE A

A solution of an acid activating agent was made by adding 1.06 grams (g) of sodium fluoride in one liter of deionized water followed by the addition of 2.19 g of 40% by weight aqueous sodium hydroxide solution and 11.75 g of 23% by weight aqueous fluorosilicic acid solution. The solution had a pH of 3.0 and a fluoride concentration of 2600 ppm.

EXAMPLE B

A complex fluorotitanium compound solution was made by adding 1.94 g of 53% by weight aqueous fluorotitanic acid to one liter of deionized water. The solution had a pH of 2.1 and a titanium concentration of 300 ppm.

EXAMPLE C

The N,N-dimethylethanolamine salt of benzylaminobis(methylenephosphonic) acid ester of bisphenol A diglycidyl ether was made by first heating a solution containing 779.1 g of phosphorous acid (9.5 mole) and 592.2 g of 1-methoxy-2-propanol to 85° C. under a nitrogen atmosphere. Next, 567.1 g of benzylamine (5.3 mole) and 779.1 g of a 37 percent by weight solution of formaldehyde in water (9.6 mole formaldehyde) were added simultaneously as separate feeds over 3.3 hours to this solution. The resulting reaction mixture was held for 4 hours at 95° C. A solution of 1345.6 g bisphenol A diglycidyl ether (3.6 mole) (EPON 828 from Shell Chemical Company) and 343.5 g 1-methoxy-2-propanol was added over 1 hour and the resulting reaction mixture was heated to 90° C. for 1.5 hours. The reaction mixture was then allowed to cool to 50° C. and 437.2 g of N,N-dimethylethanolamine (4.9 mole) was added. The resulting product was a homogeneous liquid with a total solids content of 66.4 percent by weight, 3,405 milliequivalents of acid and 1.448 milliequivalents of base per gram of liquid.

EXAMPLE D

Carboxyethyl phosphonic acid mixed ester of bisphenol A diglycidyl ether and phenylglycidyl ether was made by charging to a 1 liter, 4 neck, round bottom flask fitted with a Friedrich condenser, thermometer, nitrogen inlet and heating mantle, 180 g carboxyethyl phosphonic acid and 116 g dimethylformamide (DMF) solvent. When a clear solution was obtained by stirring at 50° C., 168 g of phenylglycidyl ether was added over 15 minutes while cooling with an ice bath to maintain a temperature of 50°-57° C. After stirring for 2¾ hours at 50° C., all the epoxy groups had reacted. A solution of 95 g of EPON 828 in 95 g DMF was added over 30 minutes and the solution heated to 100° C. After 8½ hours at 100° C., the mixture was cooled at which point a potentiometrically determined acid value of 227 at 58.5 percent solids was measured. The product had a solution viscosity of W-X (Gardner-Holdt) and a hydroxyl value of 147. No unreacted epoxy groups could be detected.

EXAMPLE E

The diisopropylamine salt of the phosphoric acid ester of bisphenol A diglycidyl ether was made by first charging 67.6 g 85 percent phosphoric acid into a 2-liter flask under a nitrogen blanket which was maintained throughout the reaction. 1-Methoxy-2-propanol (67.6 g) was then added. The mixture was heated to 120° C. followed by the addition of 332.4 g EPON 828 premixed with the 1-methoxy-2-propanol (85 to 15 weight ratio) over 30 minutes. The temperature of the reaction mixture was maintained at 120° C. When the addition was complete, the temperature was held at 120° C. for another 30 minutes followed by the addition of 63.4 g deionized water over a 5-minute period. When the water addition was completed, the mixture was held for 2 hours at reflux (106° C.) followed by cooling to 70° C. Premelted diisopropanolamine (100.6 g) was then added to the reaction mixture at 70° C. and the reaction mixture stirred for 15 minutes. The pH of the reaction mixture was adjusted to 6.0 by adding the small amounts of additional diisopropanolamine. The reaction mixture was then further thinned with an additional 309.7 g of deionized water.

EXAMPLE F

The diisopropanolamine salt of carboxyethyl phosphonic acid mixed ester of bisphenol A diglycidyl ether and butylglycidyl ether was made by first charging the following to a 3 liter, 4 neck, round bottom flask fitted with a thermometer, stainless steel stirrer, nitrogen inlet, heating mantle and reflux condenser:

Carboxyethyl phosphonic acid: 145 g

Dimethylformamide: 145 g.

When a clear solution was obtained at 50° C., a mixture of 190 g of the diglycidyl ether of bisphenol A and 130 g of butylglycidyl ether was added over 1½ hours while controlling the reaction exotherm to 55°-60° C. with an ice bath. The solution was heated to 100° C. and held at 100° C. for 5½ hours after which a measured epoxy equivalent weight of 2176 was obtained. After sitting overnight at ambient temperature, an additional 6 hours of heating at 110° C. gave an epoxy equivalent weight of 9680. The resin was thinned with a mixture of 47.6 g diisopropanolamine, 227 g deionized water and 320 g of the 1-methoxy-2-propanol. This procedure gave a final product with a non-volatile content of 38.8 percent and a final acid value of 67.4. The pH was 4.0 (42 percent of total theoretical neutralization).

EXAMPLE G

The N,N-dimethylethanolamine salt of cocoaminobis(methylenephosphonic) acid ester of bisphenol A diglycidyl ether was prepared as follows:

A solution containing 98.0 g of phosphorous acid (1.19 mole) and 75.0 g of 1-methoxy-2-propanol was heated to 85° C. under a nitrogen atmosphere. Next, 130.0 g of cocoamine (ARMEEN CD from Armak Chemicals, a division of AKZO Chemie America) (0.66 mole, having an amine equivalent weight of 196) and 98.0 g of a 37 percent by weight solution of formaldehyde in water (1.20 mole formaldehyde) were added simultaneously as separate feeds over 1.5 hours to this solution. The resulting reaction mixture was held for 4 hours at reflux temperature (98°-100° C.), whereupon a mixture containing 116.2 g of EPON 828 (0.30 mole) and 30.0 g of 1-methoxy-2-propanol was added over 1 hour, after which the reaction mixture was held at reflux for 1.5 hours. The resulting product was cooled to 60° C. and then neutralized by the addition of 55.0 g of N,N-dimethylethanolamine (0.62 mole) over 15 minutes after which the resulting product was allowed to cool to room temperature. The resulting reaction product had a Gardner-Holdt bubble tube viscosity of X, a total solids content of 67 percent by weight, and a pH of 5.35.

EXAMPLE H

An aqueous solution of the organophosphonate of Example C was prepared by adding with stirring 12.04 g of the reaction product of Example C to one liter of deionized water. The concentration of the solution was 0.8 percent by weight of organophosphonate based on weight of solution.

EXAMPLE I

An aqueous solution of the organophosphonate of Example D was prepared by adding with stirring sufficient reaction product of Example D to one liter of deionized water to form a solution containing 0.1 percent by weight of the organophosphonate based on weight of solution.

EXAMPLE J

An aqueous solution of the organophosphate of Example E was prepared by adding with the stirring sufficient reaction product of Example E to one liter of deionized water to form a solution containing 5 percent by weight of the organophosphate based on weight of solution.

EXAMPLE K

An aqueous solution of the organophosphonate of Example F was prepared by adding with stirring sufficient reaction product of Example F to one liter of deionized water to form a solution containing 0.1 percent by weight of the organophosphonate based on weight of solution.

EXAMPLE L

An aqueous solution of the organophosphonate of Example G was prepared by adding with stirring sufficient reaction product of Example G to one liter of deionized water to form a solution containing 0.1 percent by weight of the organophosphonate based on weight of solution.

EXAMPLE 1

Aluminum panels were subjected to an alkaline cleaning procedure by immersion in a 1.5 percent by weight bath of CHEMKLEEN 49D which is available from Chemfil Corp. at a temperature of 140° F. (60° C.) for 60 seconds. The panels were removed from the alkaline cleaning bath, rinsed with water, followed by immersion in a bath of the acid activating agent of Example A for 60 seconds at 140° F. (60° C.). The panels were then removed, rinsed with water and immersed in the fluorotitanium compound solution (140° F. [60° C.]) of Example B for 60 seconds. The panels were removed from this solution, rinsed with water and then immersed in the aqueous solution of an organophosphonate of Example H for 60 seconds at 70° F. (21° C.). The panels were removed from the aqueous solution, rinsed with water and dried with warm air at 104° F. (40° C.) for 3 minutes and then oven baked for 1 minute at 115° C. The panels were then topcoated with the clear powder coating composition based on an epoxy resin and a polyanhydride curing agent available from PPG Industries, Inc. as PCC 10103. The clear coated panels which had a coating thickness of 2 to 4 mils were subjected to General Motors Corp. thermal shock test (GM9525P) for paint adhesion. The thermal shock test was conducted by immersing the coated panels in a 38° C. water bath for 3 hours followed immediately by placement into freezer at −29° C. for a minimum of 3 hours. Within 60 seconds of removal from freezer, the panels were scribed with an "X" across the entire panel and blasted with high pressure (37.9 kPa) steam at a 45° angle and 50 mm distance with respect to the scribe lines. Performance was measured with respect to paint loss from scribe line(s). Little or no paint loss (0 to 1 mm) was evidenced. Untreated control panels resulted in a 100 percent paint loss when tested in this manner.

EXAMPLE 2

Example 1 was repeated except that the fluorotitanium treatment was omitted and times and temperatures of the other treatments were modified as follows. The alkaline cleaning was conducted by immersion for 10 seconds at 140° F. (60° C.). The acid activation step was conducted on two different panels by immersion for 10 and 30 seconds, respectively, at 140° F. (60° C.). The organophosphonate application was conducted by immersion for 10 and 30 seconds, respectively, at 70° F. (21° C.). Also, the panels were topcoated with a coil primer and topcoat available from PPG Industries, Inc. as 4PLY41250 and 1LW4842, respectively. The primer was based on chromate containing acrylic latex and had a film thickness of 0.2 mils. The topcoat was based on an acrylic latex available from PPG Industries, Inc. under the trademark ENVIRON and had a thickness of 0.8 mils.

The coated panels were tested for flexibility via a T-bend test, for pencil hardness, for water soak recovery time and for percent water absorption.

The T-bend test was conducted by cutting a 2-inch strip from a coated panel and bending it back upon itself. A 3 T bend means the diameter of the bend is three times the thickness of the panel. A 2 T bend means the diameter of the bend is two times the thickness of the panel. A 0 T bend means that the panel is bent back over itself 180 degrees and compressed flat. The coating was observed visually for cracking and for removal of film after a piece of adhesive tape was pressed down onto the coating and then rapidly pulled off the panel at right angles to the plane of the surface being tested. Each bend is then examined and rated both for plant "pickoff" and paint cracking. Ratings were given at the bend at which no pickoff (NP) is seen and at the bend at which no cracking (NC) is seen. Lower values correspond to the most severe/stressful bends and are therefore indicative of the greater flexibility imparted by the coating pretreatment system. The pencil hardness test was conducted by abrading a pencil of a given hardness (2H>H>F>HB>B>2B) with emery cloth to form a sharp edge. Holding a pencil at a 45° angle to the coating surface, the pencil was pushed through the coating. This was repeated with progressively softer pencils until a given pencil does not cut through the coating. Hardness was denoted by the hardest pencil that does not cut through the coating. The water soak test was conducted by immersing panels for 24 hours at 100° F. (38° C.) in a deionized water bath. Upon removal from the bath, panels were immediately tested for pencil hardness as described above and every two minutes thereafter until the film fully recovers (to initial hardness). The amount of water absorbed (percent water absorption) by the panels was determined gravimetrically. Fast recovery times and low percent absorption were indicative of strong adhesive interactions at the pretreatment-coating interface. The results of tests at 10 and 30 second treatments are shown in Table I.

TABLE I

| Acid Activation Treatment (time) | Pre-treatment (time) | T-Bend NP/NC | Pencil Initial | Water Soak Recovery Time | % Water Absorption |
|---|---|---|---|---|---|
| 10 seconds | 10 seconds | 2T/3T | B | 0 minutes | 2.3 |
| 30 seconds | 30 seconds | 0T/2T | B | 0 minutes | 2.8 |

EXAMPLE 3

Example 1 was repeated except that the fluorotitanium treatment was omitted and the acid activation was conducted via immersion for 60 seconds at 120° F. (49° C.). Also, the panels were topcoated with an aminoplast cured polyester topcoat available from PPG as POLYCRON III. The topcoat had a thickness of 1.0 mils. The panels were tested for film adhesion, impact resistance, detergent resistance and corrosion (salt spray and humidity) resistance as specified by the AAMA 603.8-85 publication. The results of the tests as well as those for an untreated control are shown in Table II below.

EXAMPLES 4-7

Example 3 was repeated except that the organophosphonate treatment was conducted with the organophosphonates and organophosphate solutions of Examples I, J, K and L. The results of the testing is shown in Table II below.

| Example | Organophosphonate or Organo phosphate Solution | Wet Adhesion[1] | Impact Resistance[2] | Detergent Resistance[3] | Salt Spray Resistance[4] | Humidity Resistance[5] |
|---|---|---|---|---|---|---|
| Control | none | 0 | F | F | 4/6 | D#6 |
| 3 | Example H | 5 | P | P | 9/10 | clean |
| 4 | Example I | 5 | P | P | 9/9 | F#8 |
| 5 | Example J | 5 | | P | 10/10 | clean |
| 6 | Example K | 5 | P | P | 7/8 | D#6 |
| 7 | Example L | 4 | P | P | 8/9 | clean |

[1]Eleven (11) parallel cuts 1/16 inch apart were made through the coating. Eleven (11) similar cuts at 90 degrees to and crossing the first 11 cuts were also made. The substrate was then immersed in distilled water at 100° F. (38° C.) for 24 hours, removed and wiped dry. Within five minutes adhesive tape ¾ inch wide was pressed firmly over the area of the cuts and then pulled sharply at right angles to the plane of the surface being tested. In the above testing, a rating of 5 indicates 0% paint loss, a rating of 4 indicates 1-10% paint loss and a rating of 0 indicates >70% paint loss.

[2]A ⅝ inch diameter round nose impacter is used to perform the impact resistance test. The impact load is applied directly to the coated surface using a Gardner Variable Impact Tester (160 inch-pounds range) of sufficient force to deform the test sample a minimum of 0.10 inch. ¾ inch wide adhesive tape was applied firmly over the deformed area and then sharply pulled off at right angles to the plane of the surface being tested. A value of "P" indicates a pass or no paint removed. A value of "F" or fail indicates substantial paint removal.

[3]Detergent resistance is determined by first preparing a 3% by weight solution of detergent in distilled water. The test specimen is immersed in the solution at 100° F. (38° C.) for 72 hours, removed and wiped dry. ¾ inch wide adhesive tape is then pressed down against the coating along the entire length of the test specimen. The tape is pulled off at right angles to the plane of the surface being tested. A "P" value indicates pass and no loss of adhesion of the film to the metal, no blistering and no significant visual change of the coating when examined by the unaided eye. An "F" rating indicates significant loss of adhesion, blistering or visual change in appearance of the coating. The detergent solution is as follows:

| Ingredient | Percent by Weight |
|---|---|
| Tetrasodium pyrophosphate | 45 |
| Sodium sulfate (anhydrous) | 23 |
| Sodium alkylaryl sulfonate | 22 |
| Sodium metasilicate (hydrated) | 8 |
| Sodium carbonate (anhydrous) | 2 |

[4]Salt spray resistance is determined by scoring the film sufficiently to expose the base metal using a sharp knife or blade instrument. The exposed sample is exposed for 1000 hours according to ASTM B-117 using a 5% salt solution. The sample is removed and wiped dry. ¾ inch wide adhesive tape is pressed over the scored area and then sharply pulled off at right angles to the plane of the surface being tested. Ratings are given according to the following tables:

TABLE 1
Rating of Scribe Failure

| Maximum Measurement of Failure from Scribe (in.) | mm | Rating by Number |
|---|---|---|
| 0 | 0 | 10 |
| 1/64 | 0.4 | 9 |
| 1/32 | 0.8 | 8 |

-continued

| | | |
|---|---|---|
| 1/16 | 1.6 | 7 |
| 1/08 | 3.2 | 6 |
| 3/16 | 4.8 | 5 |
| 1/04 | 6.4 | 4 |
| 3/08 | 9.5 | 3 |
| 1/02 | 12.7 | 2 |
| 5/08 | 15.9 | 1 |
| 1 or more | 25 or more | 0 |

TABLE 2

Rating of Area Other than Scribe (Blisters, Corrosions, etc.) (See NOTE)

| Description of Failure (%) | Rating By Number |
|---|---|
| No failure | 10 |
| 1 | 9 |
| 2 | 8 |
| 5 | 7 |
| 7 to 10 | 6 |
| 7 to 10 larger spots | 5 |
| 11 to 25 | 4 |
| 26 to 40 | 3 |
| 41 to 60 | 2 |
| 61 to 75 | 1 |
| Over 75 | 0 |

NOTE:

The use of a ruled plastic grid is recommended as an aid in evaluating this type of failure. A ¼" (6.4 mm) grid is suggested as most practical for the usual specimen. In using the grid the number of squares in which one or more points of failure are found is related to the total number of squares covering the significant area of the specimen to get a percentage figure as used in the tabulation. In some instances, the rating numbers may be used as factors with exposure time intervals related thereto to produce a performance index number which very accurately indicates relative quality.

[5]Humidity resistance is determined by exposing the coated panel in a controlled heat and humidity cabinet for 1000 hours at 100° F. (38° C.) and 100% relative humidity with the cabinet operated in accordance with ASTM D-2247. A rating of "clean" indicates no formation of blisters. In the above evaluations, "F" indicates "few" and "D" indicates "dense". In the size of the blisters, 6>8>10.

What is claimed is:

1. A method of treating a nonferrous metallic substrate comprising the steps of:

(a) contacting the metallic substrate with a solution of an acid activating agent, so as to dissolve metal oxide film which may have formed on the nonferrous metallic substrate; followed by (b) further contacting the metallic substrate contacted in step (a) with a solution of a compound selected from a group consisting of phosphoric acid esters of epoxy compounds and phosphonic acid esters of epoxy compounds.

2. The method of claim 1 wherein in step (a) the activating agent has a temperature of from about 50° F. (10° C.) to about 180° F. (82° C.).

3. The method of claim 1 wherein in step (a) the activating agent solution has a pH of from about 2.4 to about 4.0.

4. The method of claim 3 wherein in step (a) the activating agent solution has a pH of from about 3.0 to about 3.7.

5. The method of claim 1 wherein in step (a) the activating agent is an acid fluoride.

6. The method of claim 5 wherein the activating agent is present in the solution in a concentration of from about 100 to about 5200 ppm fluoride.

7. The method of claim 6 wherein the concentration of the activating agent in solution is from about 600 to 2600 ppm fluoride.

8. The method of claim 1 wherein between step (a) and step (b) there is an additional step in which the metallic substrate is contacted with a solution of fluorotitanic or fluorozirconic compound.

9. The method of claim 1 wherein the nonferrous metallic substrate is selected from a group consisting of aluminum, zinc and aluminum-zinc alloys.

10. The method of claim 1 wherein in step (b) the solution is at a temperature of from about 50° F. (10° C.) to about 150° F. (66° C.).

11. The method of claim 10 wherein in step (b) the solution is at a temperature of from about 60° F. (16° C.) to about 80° F. (27° C.).

12. The method of claim 1 wherein in step (b) the solution has a pH of from about 3.5 to about 7.0.

13. The method of claim 12 wherein in step (b) the solution has a pH of from about 4.0 to about 6.5.

14. The method of claim 1 wherein in step (b) the compound is present in a concentration of from about 0.05 percent to 7.0 percent by weight based on weight of solution.

15. The method of claim 14 wherein in step (b) the compound is present in a concentration of about 0.65 percent to about 0.8 percent by weight based on weight of solution.

16. The method of claim 1 wherein the phosphonic acid ester is an aminobis(methylenephosphonic) acid ester of an epoxy compound.

17. The method of claim 1 wherein after step (b) the substrate is rinsed with water.

18. The method of claim 1 wherein the solution in step (a) is an aqueous solution.

19. The method of claim 2 wherein the solution in step (b) is an aqueous solution.

* * * * *